US009987844B2

(12) United States Patent
Zhao

(10) Patent No.: US 9,987,844 B2
(45) Date of Patent: Jun. 5, 2018

(54) INK-JET PRINTING HEAD, INK-JET PRINTING METHOD AND INK-JET PRINTING DEVICE

(71) Applicant: BOE TECHNOLOGY GROUP CO., LTD., Beijing (CN)

(72) Inventor: Dejiang Zhao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days. days.

(21) Appl. No.: 15/123,395

(22) PCT Filed: Jan. 15, 2016

(86) PCT No.: PCT/CN2016/070985
§ 371 (c)(1),
(2) Date: Sep. 2, 2016

(87) PCT Pub. No.: WO2017/016202
PCT Pub. Date: Feb. 2, 2017

(65) Prior Publication Data

US 2017/0157922 A1 Jun. 8, 2017

(30) Foreign Application Priority Data

Jul. 28, 2015 (CN) ..... 2015 1 0452365

(51) Int. Cl.
*B41J 2/14* (2006.01)
*B41J 2/135* (2006.01)
(Continued)

(52) U.S. Cl.
CPC ..... *B41J 2/1433* (2013.01); *B41J 2/04593* (2013.01); *B41J 2/135* (2013.01); *B41J 2/155* (2013.01)

(58) Field of Classification Search
None
See application file for complete search history.

(56) References Cited

U.S. PATENT DOCUMENTS 4,746,935 A 5/1988 Allen
5,412,410 A 5/1995 Rezanka
(Continued)

FOREIGN PATENT DOCUMENTS

CN 1365891 A 8/2002
CN 101090828 A 12/2007
(Continued)

OTHER PUBLICATIONS

1st office action issued in Chinese application No. 201510452365.2 dated Mar. 4, 2016.
(Continued)

*Primary Examiner* — Lisa M Solomon
(74) *Attorney, Agent, or Firm* — Nath, Goldberg & Meyer; Joshua B. Goldberg

(57) ABSTRACT

Disclosed are an ink-jet printing head, an ink-jet printing method using the ink-jet printing head and an ink-jet printing device including the ink-jet printing head. The ink-jet printing head includes a chamber for accommodating ink and nozzle sets provided on a sidewall of the chamber where ink is sprayed. The nozzle sets are used for ink-jet printing on pixels at different positions, respectively. Each of nozzle sets includes sub-nozzles and the sub-nozzles in each nozzle set can spray different volumes of ink. In the printing head, by providing sub-nozzles having different ink spraying volumes in each nozzle set, ink droplets having desirable volumes can be sprayed from nozzle sets such that total volumes of ink droplets sprayed at different positions from nozzle sets could be more accurate. Therefore, a thickness of a film layer formed by ink-jet printing can be flexibly controlled and adjusted, while having a significantly improved accuracy.

15 Claims, 3 Drawing Sheets

(51) Int. Cl.
*B41J 2/155* (2006.01)
*B41J 2/045* (2006.01)

(56) References Cited

U.S. PATENT DOCUMENTS

| | | | | |
|---|---|---|---|---|
| 6,592,203 | B1 | 7/2003 | Bates et al. | |
| 2003/0197756 | A1* | 10/2003 | Inoue | B41J 2/1404 347/40 |
| 2005/0156963 | A1 | 7/2005 | Song et al. | |
| 2010/0020118 | A1 | 1/2010 | Xie | |

FOREIGN PATENT DOCUMENTS

| | | | |
|---|---|---|---|
| CN | 101130299 | A | 2/2008 |
| CN | 104985933 | A | 10/2015 |
| JP | 9-164706 | A | 6/1997 |
| JP | 2004-167868 | A | 6/2004 |
| JP | 2010-162712 | A | 7/2010 |

OTHER PUBLICATIONS

Form PCT/ISA/210 issued in International application No. PCT/CN2016/070985 dated Apr. 28, 2016.
Form PCT/ISA/220 issued in International application No. PCT/CN2016/070985 dated Apr. 28, 2016.
Form PCT/ISA/237 issued in International application No. PCT/CN2016/070985 dated Apr. 28, 2016.

* cited by examiner

INK-JET PRINTING HEAD, INK-JET PRINTING METHOD AND INK-JET PRINTING DEVICE

This is a National Phase Application filed under 35 U.S.C. 371 as a national stage of PCT/CN2016/070985 filed on Jan. 15, 2016, an application claiming the benefit of Chinese application no. 201510452365.2 filed on Jul. 28, 2015, the content of each of which is hereby incorporated by reference in its entirety.

FIELD OF THE INVENTION

The disclosure relates to the field of display technologies, and in particular to an ink-jet printing head, an ink-jet printing method using the ink-jet printing head and an ink-jet printing device having the ink-jet printing head.

BACKGROUND OF THE INVENTION

An OLED display product manufactured by the ink-jet printing method has advantages of increased material utilization and shortened manufacturing period. Therefore, more and more manufacturers use the ink-jet printing method to manufacture the OLED display products.

The ink-jet printing for the OLED display product requires an accuracy of one pixel. Thus, during the ink-jet printing, a relatively high accuracy of ink droplet for printing may be required. In the meanwhile, for accurately controlling a thickness of printed film, it is also necessary to accurately control ink volume printed into each pixel.

In an ink-jet printing device, a printing head is the most essential part. Usually, a plurality of nozzles may be provided on the printing head. The plurality of nozzles may be arranged in one or more rows. At the time of printing, a certain film layer on the OLED display substrate can be printed by translating the printing head.

Usually, since the nozzles provided on the printing head have the same specification and size, the same volume of ink droplet can be discharged from the nozzles. Further, the volume of ink droplet discharged from the nozzles can only slightly fluctuate around a fixed value. Therefore, in the practical printing, a total volume of ink droplet discharged from the nozzles can only be substantial integral multiples of the fixed value. As a result, the thickness of the film layer formed on the OLED display substrate cannot be flexibly adjusted, such that the thickness of the film layer formed by printing cannot be accurately controlled, finally influencing the display performance of an OLED display product.

SUMMARY OF THE INVENTION

For above technical problems in the prior art, the disclosure provides an ink-jet printing head, an ink-jet printing method using the ink-jet printing head and an ink-jet printing device including the ink-jet printing head. The ink-jet printing head can cause each nozzle set to spray ink droplets having desirable volumes, such that total volumes of ink droplets sprayed on pixels at different positions from nozzle sets could be more accurate. Therefore, a thickness of a film layer formed by ink-jet printing can be flexibly controlled and adjusted, while having a significantly improved accuracy.

There is provided an ink-jet printing head in the disclosure, including a chamber for accommodating ink and nozzle sets provided on a sidewall of the chamber where ink is sprayed, the nozzle sets being used for ink-jet printing on pixels at different positions, respectively. Each of the nozzle sets includes sub-nozzles, and the sub-nozzles in each nozzle set are able to spray different volumes of ink.

Preferably, the sub-nozzles in each nozzle set have different specifications and sizes.

Preferably, the nozzle sets are arranged in one or more columns in parallel and the sub-nozzles in each nozzle set are arranged in a row. In each column of the nozzle sets, the sub-nozzles having the same specification and size are arranged in a column, and columns of the sub-nozzles are parallel to each other, such that the sub-nozzles in the nozzle sets are arranged in an array.

Preferably, in each column of the nozzle sets, any two adjacent columns of the sub-nozzles have an equal interval, and in each column of the sub-nozzles, any two adjacent sub-nozzles have an equal interval.

Preferably, the nozzle sets are used for ink-jet printing on respective pixels to be printed in a pixel array.

Preferably, the number of sub-nozzles in each column is equivalent to that of pixels in each column, and an interval between any two adjacent sub-nozzles in each column of sub-nozzles is equivalent to an interval between any two adjacent pixels in each column of pixels;

in the case of one column of nozzle sets, the column of nozzle sets is used for ink-jet printing on a column of pixels, and the column of nozzle sets is able to displace in parallel to successively perform the ink-jet printing on each column of pixels; or in the case of columns of nozzle sets, the columns of nozzle sets are used for ink-jet printing on columns of pixels in the pixel array at a time.

Preferably, the ink-jet printing head further comprises a calculation module and a control module. The calculation module is configured to calculate a combination mode of different sub-nozzles in the nozzle set for printing each pixel on the basis of a total ink volume required by the pixel to be printed and ink volumes capable of being sprayed by the sub-nozzles in the nozzle set, and to send the combination mode to the control module. The control module is configured to control the ink spraying volume of the sub-nozzles on the basis of the combination mode.

Preferably, the sidewall of the chamber for spraying ink is provided with partitions on its inside, and the partitions are interposed between any two adjacent columns of sub-nozzles, or, the partitions are uniformly distributed in spaced regions between the nozzle sets, so as to divide an area where the nozzle sets are located into areas having equivalent size.

Preferably, the partitions divide the whole chamber into sub-chambers, or, the partitions divide a bottom portion of the chamber closed to the sidewall where the ink is sprayed into sub-chambers such that top portions of the sub-chambers far away from the sidewall where the ink is sprayed are communicated with each other.

There is also provided an ink-jet printing device including the ink-jet printing head as described above.

There is further provided an ink-jet printing method using the ink-jet printing head as described above, the method comprises steps of: firstly, determining a total ink volume required by pixels to be printed at different positions; then, in accordance with the total ink volume required by pixels to be printed at different positions and ink volumes capable of being sprayed by the sub-nozzles in the nozzle set, calculating a combination mode of different sub-nozzles in the nozzle set for the pixels to be printed at positions; and in the end, on the basis of the combination mode, controlling the ink-jet printing of the sub-nozzles.

The embodiments of the disclosure have following advantageous effects: in the ink-jet printing head according to the disclosure, by providing sub-nozzles having different ink spraying volumes in each nozzle set, ink droplets having desirable volumes can be sprayed from nozzle sets such that total volumes of ink droplets sprayed at different positions from nozzle sets could be more accurate. Therefore, a thickness of a film layer formed by ink-jet printing can be flexibly controlled and adjusted, while having a significantly improved accuracy.

In the ink-jet printing device according to the disclosure, due to the use of the ink-jet printing head as described above, the ink-jet printing device can flexibly control and adjust the thickness of the printed film layer, thereby improving the accuracy of ink-jet printing.

DETAILED DESCRIPTION OF THE EMBODIMENTS

In order to better understand the inventive technical schemes by those skilled in the art, an ink-jet printing head, an ink-jet printing method using the ink-jet printing head and an ink-jet printing device having the ink-jet printing head according the disclosure will be further described in detail in conjunction with accompanying drawings and specific implementations hereinafter.

First Embodiment

Figure 1:
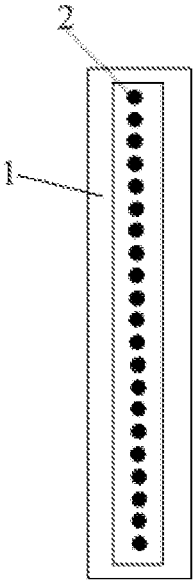
FIG. 1 is a structural diagram schematically illustrating an ink-jet printing head according to a first embodiment of the disclosure.
Figure 2:
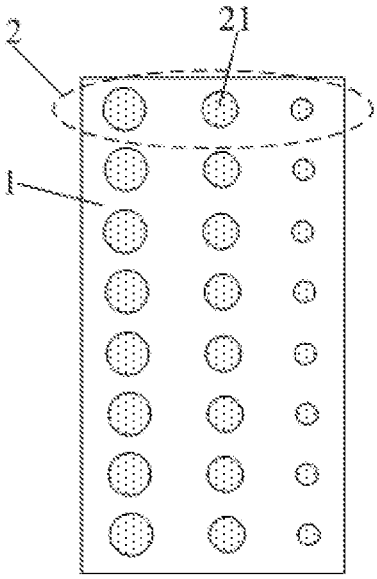
FIG. 2 is a partial enlarged diagram of the ink-jet printing head as shown in FIG. 1.

An ink-jet printing head provided in this embodiment, as shown in FIGS. 1 and 2, may include a chamber 1 for accommodating ink and a plurality of nozzle sets 2 provided on a sidewall of the chamber 1 where ink is sprayed, the nozzle sets 2 are used for ink-jet printing on pixels at different positions, respectively, wherein each of the nozzle sets 2 includes a plurality of sub-nozzles 21 (three sub-nozzles in this embodiment), and the plurality of sub-nozzles 21 in each nozzle set 2 are able to spray different volumes of ink.

By providing the plurality of sub-nozzles 21 having different ink spraying volumes in each nozzle set 2, ink droplets having desirable volumes can be sprayed from nozzle sets 2 such that total volumes of ink droplets sprayed at different positions from the nozzle sets 2 could be more accurate. Therefore, a thickness of a film layer formed by ink-jet printing can be flexibly controlled and adjusted, while the accuracy of the thickness of the film layer formed by ink-jet printing can be significantly improved.

Herein, the sub-nozzles 21 in each nozzle set 2 may have different specifications and sizes. In such an arrangement, ink droplets having different volumes can be sprayed from the sub-nozzles 21 in each nozzle set 2.

In this embodiment, the nozzle sets 2 are arranged in a column along a longitudinal direction in the figures, while the sub-nozzles 21 in each nozzle set 2 are arranged in a row along a transversal direction in the figures. In such a manner, a column of nozzle sets 2 may be formed into an array of sub-nozzles 21, wherein the sub-nozzles 21 having the same specification and size are arranged in a column and columns of the sub-nozzles 21 are parallel to each other.

Herein, in a column of nozzle sets 2, any two adjacent columns of the sub-nozzles 21 have an equal interval (i.e., a transversal interval in the figures), while in each column of the sub-nozzles 21, any two adjacent sub-nozzles 21 have an equal interval (i.e., a longitudinal interval in the figures).

Figure 3:
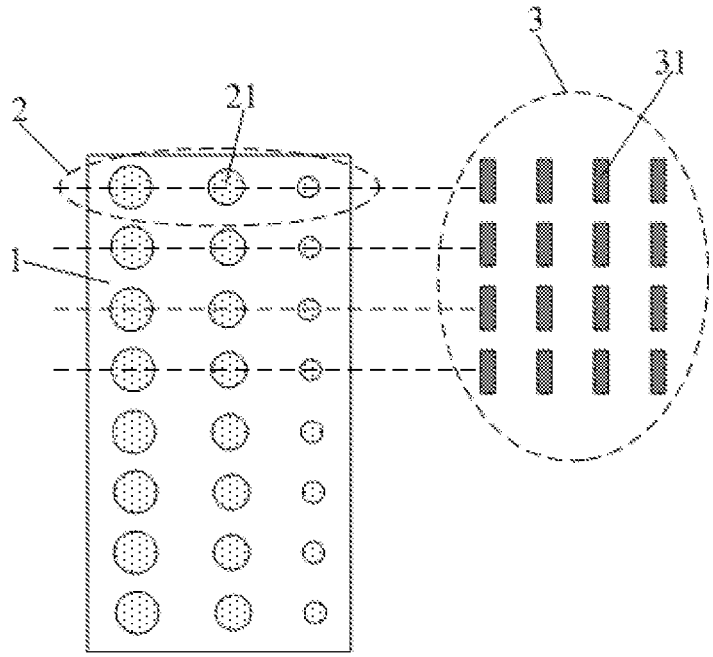
FIG. 3 is a diagram schematically illustrating a correspondence between sub-nozzles in the ink-jet printing head as shown in FIG. 1 and pixels in a pixel array.

In this embodiment, as shown in FIG. 3, the nozzle sets 2 are used for ink-jet printing on pixels 31 to be printed in a pixel array 3. Since each of the nozzle sets 2 includes a plurality of sub-nozzles 21, the ink printing volume of each pixel 31 can be accurately controlled, thereby improving the printing efficiency of the pixels 31 in the pixel array 3.

In this embodiment, preferably, the number of sub-nozzles 21 in each column is equivalent to that of pixels 31 in each column, and an interval between any two adjacent sub-nozzles 21 in each column of sub-nozzles 21 (i.e., a longitudinal interval in the figures) is equivalent to an interval between any two adjacent pixels 31 in each column of pixels 31 (i.e., a longitudinal interval in the figures). One column of nozzle sets 2 is provided in this embodiment. This column of nozzle sets 2 is used for ink-jet printing on a column of pixels 31. Then, this column of nozzle sets 2 is able to displace in parallel to successively perform the ink-jet printing on each column of pixels 31 in the pixel array 3.

Herein, there can be two situations in which a column of nozzle sets 2 performs the ink-jet printing on a column of pixels 31. In one situation, a transverse width of the nozzle set including a plurality of sub-nozzles 21 is less than or equal to a transverse width of a pixel 31. At this point, the positions of the nozzle sets 2 in this column of nozzle sets 2 can correspond to respective pixels 31 in a column of pixels 31, so that ink droplets sprayed from sub-nozzles 21 in a nozzle set 2 can surely fall into a pixel 31 corresponding thereto. In such a manner, the sub-nozzles 21 in each nozzle set 2 can simultaneously spray ink when printing, thereby achieving the simultaneous printing on each pixel 31 in a column of pixels 31. In the other situation, a transverse width of the nozzle set including a plurality of sub-nozzles 21 is greater than a transverse width of a pixel 31. At this point, the sub-nozzles 21 in this column of nozzle sets 2 cannot correspond to respective pixels 31 in a column of pixels 31. This means that ink droplets sprayed from sub-nozzles 21 in a nozzle set 2 cannot simultaneously fall into a pixel 31 corresponding thereto. Therefore, in this case, when printing, it is necessary to match positions of columns of the sub-nozzles 21 in the column of nozzle set 2 with positions of this column of pixels 31, respectively, and the ink-jet printing is performed when the positions are matched. In this embodiment, it is possible to translate the ink-jet printing head to complete the printing process of columns of the sub-nozzles 21. Both situations as stated above can efficiently and rapidly provide the ink-jet printing for a column of pixels 31 in the pixel array 3 and can accurately control the ink spraying volume of each pixel 31.

Since there is only one column of nozzle set 2 in this embodiment, this column of nozzle set 2 is able to translate to successively print columns of pixels 31 in the pixel array 3.

In this embodiment, the ink-jet printing head may further comprise a calculation module and a control module (not shown), wherein the calculation module is configured to calculate a combination mode of different sub-nozzles 21 in the nozzle set 2 for printing each pixel 31 on the basis of a total ink volume required by the pixel 31 to be printed and ink volumes capable of being sprayed by the sub-nozzles 21 in the nozzle set 2, and to send the combination mode to the control module; and the control module is configured to control the ink spraying volume of the sub-nozzles 21 on the basis of the combination mode.

For example, in this embodiment, each nozzle set 2 may include three sub-nozzles 21. The three sub-nozzles 21 can spray ink droplet volumes of 30 pL, 20 pL and 10 pL, respectively, at a time, and the ink spraying volume of each sub-nozzle 21 can be finely adjusted in a range of plus/minus 2 pL. Assuming that a total ink volume of 63 pL is required for printing each pixel 31, then the calculation module is able to calculate the combination mode of the ink spraying volumes of sub-nozzles 21 at the time of the total ink volume of 63 pL: $63=(30-2)+(20-1)+2\times(10-2)$. In other words, when a pixel 31 is being printed, an ink droplet of 30 pL is printed (the sub-nozzles 21 of 30 pL spray for one droplet), an ink droplet of 20 pL is printed (the sub-nozzles 21 of 20 pL spray for one droplet), and two ink droplets of 10 pL are printed (the sub-nozzles 21 of 10 pL spray for two droplets). In this manner, the accurate printing of a pixel 31 can be achieved.

The calculation module and the control module are arranged such that the sub-nozzles 21 can be appropriately combined when spraying ink. Thus, the ink spraying volume can be more easily adjusted and controlled, improving the accuracy of the volume of sprayed ink.

It should be explained that, in the process of printing, if the ink spraying volumes of just some of sub-nozzles 21 in the nozzle set 2 can be combined to form the total ink volume required for printing a pixel 31, then the remaining sub-nozzles 21 (i.e., unused sub-nozzles 21 in the combination mode) in the nozzle set 2 may not perform the ink-jet printing in the process of printing. Since each of the sub-nozzles 21 in nozzle set 2 can be separately controlled, it is very easy to complete above processes.

Figure 4:
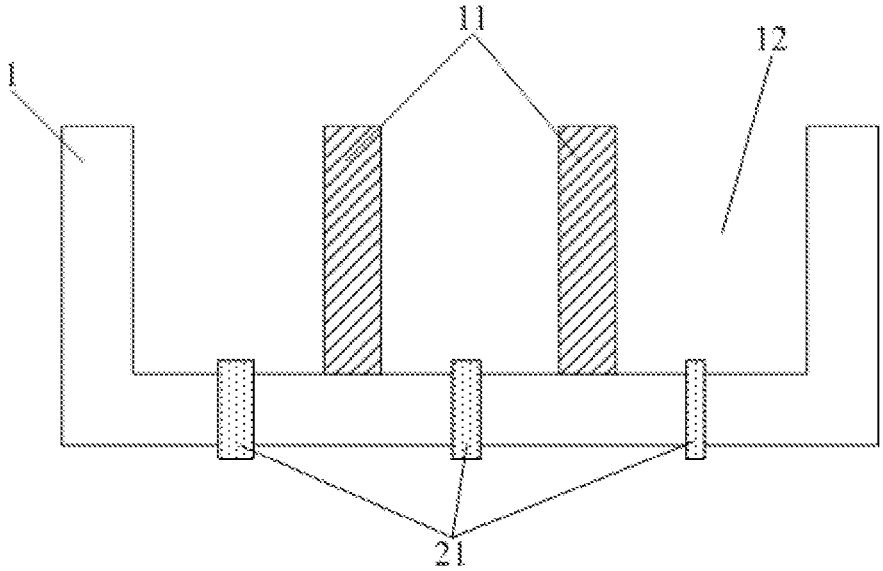
FIG. 4 is a cross-sectional diagram of a partition in the ink-jet printing head according to the first embodiment of the disclosure.

In this embodiment, as shown in FIG. 4, the sidewall of the chamber 1 for spraying ink may be provided with a plurality of partitions 11 on its inside, and the partitions 11 may be interposed between any two adjacent columns of sub-nozzles 21. The partitions 11 are arranged such that the sub-nozzles 21 with different specifications may supply ink without mutually influencing. In such a manner, it is possible to easily monitor the supply of ink, thereby ensuring the successful printing.

It should be explained that the partitions 11 may also be uniformly distributed in spaced regions between the nozzle sets 2, so as to divide an area where the nozzle sets 2 are located into areas having equivalent size. In such an arrangement, it is possible to avoid the mutual influence of the supply of ink between the nozzle sets 2 in different areas when printing ink. In such a manner, it is possible to easily monitor the supply of ink, thereby ensuring the successful printing.

Figure 5:
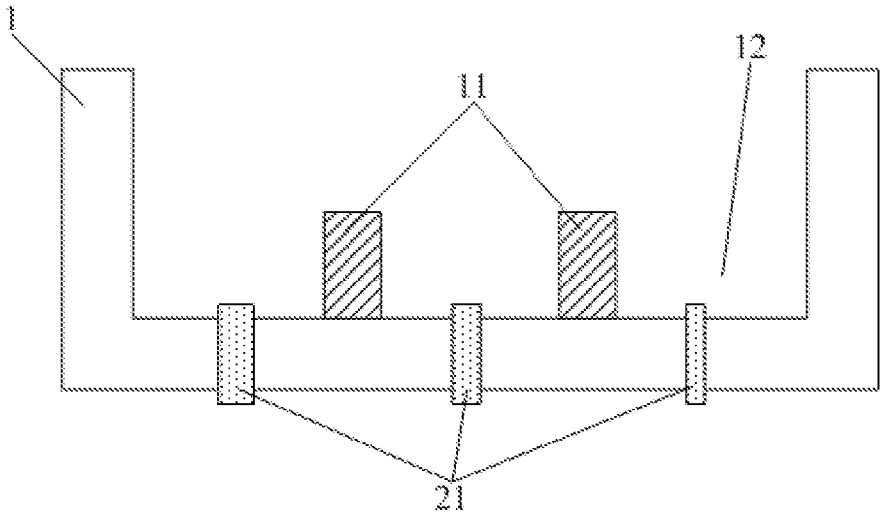
FIG. 5 is a cross-sectional diagram of another partition in the ink-jet printing head according to the first embodiment of the disclosure.

In this embodiment, the partitions 11 may divide the whole chamber 1 into a plurality of sub-chambers 12 (as shown in FIG. 4). Of course, top portions of the sub-chambers 12 far away from a sidewall where the ink is sprayed may be communicated with each other (as shown in FIG. 5). In both manners, the mutual influence of the supply of ink between the spaced areas can be avoided, thereby making it easy to monitor the supply of ink.

Based on above structure of the ink-jet printing head in this embodiment, there is provided an ink-jet printing method using the ink-jet printing head in the embedment. The method may comprise steps of: firstly, determining a total ink volume required by pixels to be printed at different positions; then, in accordance with the total ink volume required by pixels to be printed at different positions and ink volumes capable of being sprayed by the sub-nozzles in the nozzle set, calculating a combination mode of different sub-nozzles in the nozzle set for the pixels to be printed at positions; and in the end, on the basis of the combination mode, controlling the ink-jet printing of the sub-nozzles. Through this printing method, it is possible to accurately print the pixels at various positions.

Second Embodiment

Figure 6:
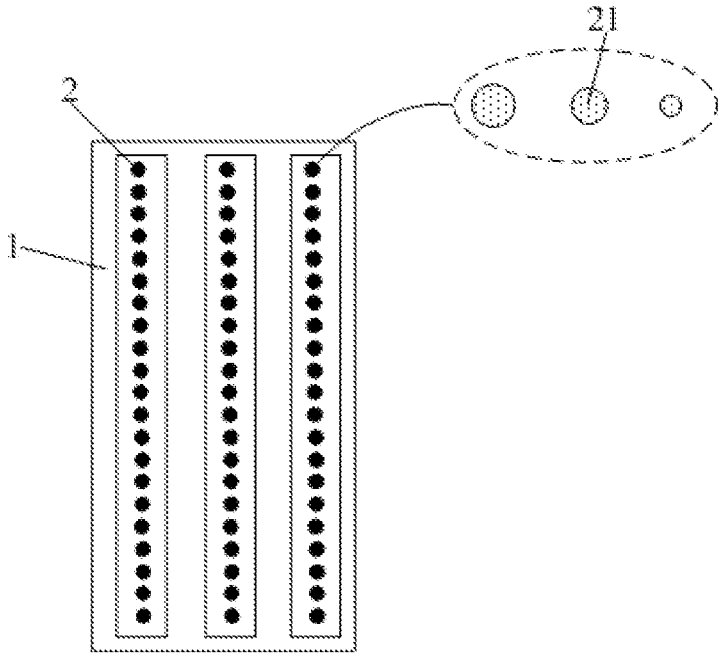
FIG. 6 is a structural diagram schematically illustrating an ink-jet printing head according to a second embodiment of the disclosure.

There is provided an ink-jet printing head in this embodiment. Different from the first embodiment, as shown in FIG. 6, the ink-jet printing head according to this embodiment may include columns of nozzle sets 2 in parallel. The nozzle set 2 in the columns of nozzle sets 2 may correspond to pixels in a pixel array, such that the columns of nozzle sets 2 may perform ink-jet printing on all of the pixels in the pixel array at a time.

In accordance with above arrangement, the columns of nozzle sets 2 are able to simultaneously perform the ink-jet printing, such that all of the pixels in the pixel array can be completely printed at a time, thereby improving the printing efficiency.

It should be explained that, preferably, in the printing head according to this embodiment, a transverse width of the nozzle set 2 including a plurality of sub-nozzles 21 is less than or equal to a transverse width of a pixel. In this case, positions of an array of the columns of nozzle sets 2 can correspond to positions of respective pixels. Therefore, when all of the sub-nozzles 21 are used to print simultaneously, all of the pixels can be completely printed at a time, thereby improving the printing efficiency of pixels.

Of course, in the printing head according to this embodiment, a transverse width of the nozzle set 2 including a plurality of sub-nozzles 21 may also be greater than a transverse width of a pixel. In this case, positions of an array of the columns of nozzle sets 2 cannot correspond to positions of respective pixels. Therefore, the printing of all of the pixels cannot be completed at a time. In this case, by displacing the ink-jet printing head in parallel, columns of sub-nozzles 21 in the nozzle sets 2 may complete printing successively. In such a manner, a number of printing times is at most equal to the number of sub-nozzles 21 in the nozzle set 2.

Other structures of the ink-jet printing head in this embodiment are the same as those in the first embodiment, and the printing method using the ink-jet printing head in this embodiment is also the same as that in the first embodiment. Therefore, the description thereof will be omitted herein.

Third Embodiment

In this embodiment, there is provided an ink-jet printing device including an ink-jet printing head according to the first or second embodiment.

By the ink-jet printing head according to the first or second embodiment, the ink-jet printing device is able to flexibly control and adjust the thickness of the film layer to be printed, thereby improving the accuracy of the ink-jet printing of the ink-jet printing device.

It should be understood that the above implementations are merely exemplary embodiments for the purpose of illustrating the principle of the disclosure, and the disclosure is not limited thereto. Various modifications and improvements can be made by a person having ordinary skill in the art without departing from the spirit and essence of the disclosure. Accordingly, all of the modifications and improvements also fall into the protection scope of the disclosure.

The invention claimed is:

1. An ink-jet printing head, including a chamber for accommodating ink and nozzle sets provided on a sidewall of the chamber where ink is sprayed, the nozzle sets being used for ink-jet printing on pixels at different positions, respectively, wherein each of the nozzle sets includes sub-nozzles, and the sub-nozzles in each nozzle set are able to spray different volumes of ink;

the sub-nozzles in each nozzle set have different specifications and sizes;

the nozzle sets are arranged in one or more columns in parallel, and the sub-nozzles in the nozzle set in any one of columns are arranged in a row and aligned to the sub-nozzles in the adjacent nozzle set in the adjacent column;

in each column of the nozzle sets, the sub-nozzles having the same specification and size are arranged in a column, and columns of the sub-nozzles are parallel to each other, such that the sub-nozzles in the nozzle sets in one or more columns are arranged in an array; and positions of the one or more columns of nozzle sets correspond to positions of one or more columns of pixels, so as to ink-jet print on one or more columns of pixels simultaneously.

2. The ink-jet printing head according to claim 1, wherein in each column of the nozzle sets, any two adjacent columns of the sub-nozzles have an equal interval, and in each column of the sub-nozzles, any two adjacent sub-nozzles have an equal interval.

3. The ink-jet printing head according to claim 2, wherein the nozzle sets are used for ink-jet printing on pixels to be printed in a pixel array.

4. The ink-jet printing head according to claim 3, wherein the number of sub-nozzles in each column is equivalent to that of pixels in each column, and an interval between any two adjacent sub-nozzles in each column of sub-nozzles is equivalent to an interval between any two adjacent pixels in each column of pixels;

in the case of one column of nozzle sets, the column of nozzle sets is used for ink-jet printing on a column of pixels, and the column of nozzle sets is able to displace in parallel to successively perform the ink-jet printing on each column of pixels; or in the case of columns of nozzle sets, the columns of nozzle sets are used for ink-jet printing on columns of pixels in the pixel array at a time.

5. The ink-jet printing head according to claim 4, wherein the ink-jet printing head further comprises a calculation module and a control module, the calculation module is configured to calculate a combination mode of different sub-nozzles in the nozzle set for printing each pixel on the basis of a total ink volume required by the pixel to be printed and ink volumes capable of being sprayed by the sub-nozzles in the nozzle set, and to send the combination mode to the control module; and the control module is configured to control the ink spraying volume of the sub-nozzles on the basis of the combination mode.

6. The ink-jet printing head according to claim 1, wherein the sidewall of the chamber for spraying ink is provided with partitions on its inside, and the partitions are interposed between any two adjacent columns of sub-nozzles, or the partitions are uniformly distributed in spaced regions between the nozzle sets, so as to divide an area where the nozzle sets are located into areas having equivalent size.

7. The ink-jet printing head according to claim 6, wherein the partitions divide the whole chamber into sub-chambers, or the partitions divide a bottom portion of the chamber closed to the sidewall where the ink is sprayed into sub-chambers such that top portions of the sub-chambers far away from the sidewall where the ink is sprayed are communicated with each other.

8. An ink-jet printing device comprising an ink-jet printing head, the ink-jet printing head including a chamber for accommodating ink and nozzle sets provided on a sidewall of the chamber where ink is sprayed, the nozzle sets being used for ink-jet printing on pixels at different positions, respectively, wherein each of the nozzle sets includes sub-nozzles, and the sub-nozzles in each nozzle set are able to spray different volumes of ink;

the sub-nozzles in each nozzle set have different specifications and sizes;

the nozzle sets are arranged in one or more columns in parallel, and the sub-nozzles in the nozzle set in any one of columns are arranged in a row aligned to the sub-nozzles in the adjacent nozzle set in the adjacent column;

in each column of the nozzle sets, the sub-nozzles having the same specification and size are arranged in a column, and columns of the sub-nozzles are parallel to each other, such that the sub-nozzles in the nozzle sets in one or more columns are arranged in an array; and positions of the one or more columns of nozzle sets correspond to positions of one or more columns of pixels, so as to ink-jet print on one or more columns of pixels simultaneously.

9. The ink-jet printing device according to claim 8, wherein in each column of the nozzle sets, any two adjacent columns of the sub-nozzles have an equal interval, and in each column of the sub-nozzles, any two adjacent sub-nozzles have an equal interval.

10. The ink-jet printing device according to claim 9, wherein the nozzle sets are used for ink-jet printing on pixels to be printed in a pixel array.

11. The ink-jet printing device according to claim 10, wherein the number of sub-nozzles in each column is equivalent to that of pixels in each column, and an interval between any two adjacent sub-nozzles in each column of sub-nozzles is equivalent to an interval between any two adjacent pixels in each column of pixels;

in the case of one column of nozzle sets, the column of nozzle sets is used for ink-jet printing on a column of pixels, and the column of nozzle sets is able to displace in parallel to successively perform the ink-jet printing on each column of pixels; or in the case of columns of nozzle sets, the columns of nozzle sets are used for ink-jet printing on columns of pixels in the pixel array at a time.

12. The ink-jet printing device according to claim 11, wherein the ink-jet printing head further comprises a calculation module and a control module, the calculation module is configured to calculate a combination mode of different sub-nozzles in the nozzle set for printing each pixel on the basis of a total ink volume required by the pixel to be printed and ink volumes capable of being sprayed by the sub-nozzles in the nozzle set, and to send the combination mode to the control module; and the control module is configured to control the ink spraying volume of the sub-nozzles on the basis of the combination mode.

13. The ink-jet printing device according to claim 8, wherein the sidewall of the chamber for spraying ink is provided with partitions on its inside, and the partitions are interposed between any two adjacent columns of sub-nozzles, or the partitions are uniformly distributed in spaced regions between the nozzle sets, so as to divide an area where the nozzle sets are located into areas having equivalent size.

14. The ink-jet printing device according to claim 13, wherein the partitions divide the whole chamber into sub-chambers, or the partitions divide a bottom portion of the chamber closed to the sidewall where the ink is sprayed into sub-chambers such that top portions of the sub-chambers far away from the sidewall where the ink is sprayed are communicated with each other.

15. An ink-jet printing method using the ink-jet printing head according to claim 1, wherein the method comprises steps of:

determining a total ink volume required by pixels to be printed at different positions;

in accordance with the total ink volume required by pixels to be printed at different positions and ink volumes capable of being sprayed by the sub-nozzles in the nozzle set, calculating a combination mode of different sub-nozzles in the nozzle set for the pixels to be printed at positions; and on the basis of the combination mode, controlling the ink-jet printing of the sub-nozzles.

* * * * *